US006086350A

United States Patent [19]

Del Monte

[11] Patent Number: 6,086,350

[45] Date of Patent: Jul. 11, 2000

[54] VARIABLE WALL CONCRETE MOLDING MACHINE

[76] Inventor: Ernest J. Del Monte, 46 Harwood La., East Rochester, N.Y. 14445

[21] Appl. No.: 08/179,770

[22] Filed: Jan. 10, 1994

Related U.S. Application Data

[63] Continuation of application No. 07/888,916, May 26, 1992, abandoned.

[51] Int. Cl.[7] ..... B28B 15/00

[52] U.S. Cl. ..... 425/62; 249/81; 249/109; 249/111; 249/120; 425/432; 425/449

[58] Field of Search ..... 425/62, 432, 444, 425/447, 449; 249/27, 33, 66.1, 67, 79, 81, 109, 111, 120, 133, 139, 155, 161, 163; 251/326; 137/862

[56] References Cited

U.S. PATENT DOCUMENTS

| | | | |
|---|---|---|---|
| 2,530,102 | 11/1950 | Von Bampus | 249/27 |
| 3,189,960 | 6/1965 | Bright | 164/131 |
| 3,441,243 | 4/1969 | Walz | 249/81 |
| 3,604,455 | 9/1971 | Therneau | 137/583 |
| 3,689,022 | 9/1972 | Rossetti | 249/81 |
| 3,732,052 | 5/1973 | Gunia | 425/219 |
| 3,770,016 | 11/1973 | Johnstone et al. | 137/625.22 |
| 3,804,361 | 4/1974 | Camus | 249/78 |
| 3,822,855 | 7/1974 | Hummelshoj | 249/79 |
| 3,837,613 | 9/1974 | Sontag | 249/66.1 |
| 3,844,524 | 10/1974 | Fisher et al. | 249/120 |
| 3,853,452 | 12/1974 | Del Monte | 425/450.1 |
| 3,881,856 | 5/1975 | Fougea | 425/432 |
| 3,884,613 | 5/1975 | van der Lely | 249/27 |
| 4,029,289 | 6/1977 | Miffre | 251/326 |
| 4,042,659 | 8/1977 | Botting et al. | 249/27 |
| 4,147,323 | 4/1979 | Welden | 249/79 |
| 4,191,521 | 3/1980 | Muldrey et al. | 425/432 |
| 4,240,999 | 12/1980 | Decker, Jr. | 264/46.5 |
| 4,244,682 | 1/1981 | Willingham | 425/62 |
| 4,253,817 | 3/1981 | Stinton et al. | 425/447 |
| 4,505,452 | 3/1985 | Bragin et al. | 251/326 |
| 4,534,924 | 8/1985 | Kariakin | 264/259 |
| 4,548,237 | 10/1985 | Bogenschutz | 137/625.22 |
| 4,761,126 | 8/1988 | del Valle | 425/62 |
| 4,884,958 | 12/1989 | Lowndes, III et al. | 425/62 |
| 4,890,999 | 1/1990 | Del Monte | 425/439 |
| 5,106,285 | 4/1992 | Preston | 425/435 |

FOREIGN PATENT DOCUMENTS

| | | | |
|---|---|---|---|
| 2306058 | 10/1976 | France | 249/81 |
| 224665 | 7/1910 | Germany | 249/81 |

*Primary Examiner*—James P. Mackey
*Attorney, Agent, or Firm*—Cumpston & Shaw

[57] ABSTRACT

A portable concrete molding apparatus for forming concrete structures of a predetermined configuration, either on-site or at a central manufacturing facility. The apparatus includes a trailer having furnace plenum bounded by a pair of fixed walls. Each fixed wall cooperates with a movable wall for forming a mold therebetween. Each movable wall includes a concrete inlet for introducing concrete into the bottom portion of the mold. The fixed and movable walls include push-off valves for ensuring separation of a concrete structure from the mold walls, as the mold walls are separated.

17 Claims, 7 Drawing Sheets

VARIABLE WALL CONCRETE MOLDING MACHINE

This is a continuation of U.S. Ser. No. 07/888,916, filed May 26, 1992, now abandoned.

The present invention relates to concrete molding machines, and more particularly, to a portable concrete molding machine for mass producing vertically oriented concrete panels having any of a variety of dimensions.

BACKGROUND OF THE INVENTION

U.S. Pat. No. 4,534,924 discloses a battery mold for molding concrete slabs. The battery mold may include manifold means in fluid communication with the bottom of each cavity formed between adjacent plates, for introducing concrete into each cavity.

U.S. Pat. No. 3,881,856 discloses a plant for the fabrication of parallel molded construction elements. The plant includes a plurality of form panels movable along a pair of support rails. The form panels are provided with vibrator devices and heating conduits. A latching assembly provides for the coupling and uncoupling of adjacent panels. Once the panels are in the desired position, the concrete is poured into the mold.

U.S. Pat. No. 3,844,524 discloses a concrete molding machine wherein concrete is admitted to the open top of a plurality of cavities formed between vertically supported panels. The panels include a hot liquid piping system for decreasing the setting time of the concrete.

U.S. Pat. No. 3,804,361 discloses a plant for manufacturing reinforced concrete construction panels. The plant includes electrically heated forms having a major surface which may be disposed perpendicular to planar vertical partition members to form a mold therebetween. Upon formation of the mold, the concrete is poured into the mold from the upper end of the mold.

While the devices of the prior art provide for mass production of concrete structures, a need exits for the formation of concrete structures having differing dimensions, wherein the structures may be formed in heated cavities either on site, or at a central manufacturing facility. In addition, the need exists for minimizing the size and number of air pockets at the interface of the mold and the concrete in the mold.

SUMMARY OF THE INVENTION

The present invention provides a mobile concrete molding apparatus for forming concrete panels of varying dimensions. Preferably, the molding apparatus is affixed to a trailer bed, so that concrete panels may be formed either on site, or at central manufacturing facilities.

The present invention includes a furnace plenum partially bounded by a pair of fixed walls, such that the fixed walls are thermally coupled to the furnace plenum. A movable wall is cooperatively associated with each fixed wall. Each movable wall includes a planar surface extending parallel to the corresponding fixed wall, and is movable in a direction normal to the corresponding fixed wall.

Preferably, each movable wall includes a concrete inlet for introducing concrete into the lower portion of the mold, such that the concrete substantially fills the mold from the bottom. That is, at least a portion of the concrete introduced through the concrete inlet acts against a pressure head of concrete in the mold. By pumping the concrete into the bottom of the mold, the number and size of the trapped air pockets at the interface of the mold surface and the concrete is minimized.

DETAILED DESCRIPTION OF THE PREFERRED EMBODIMENT

Figure 1:
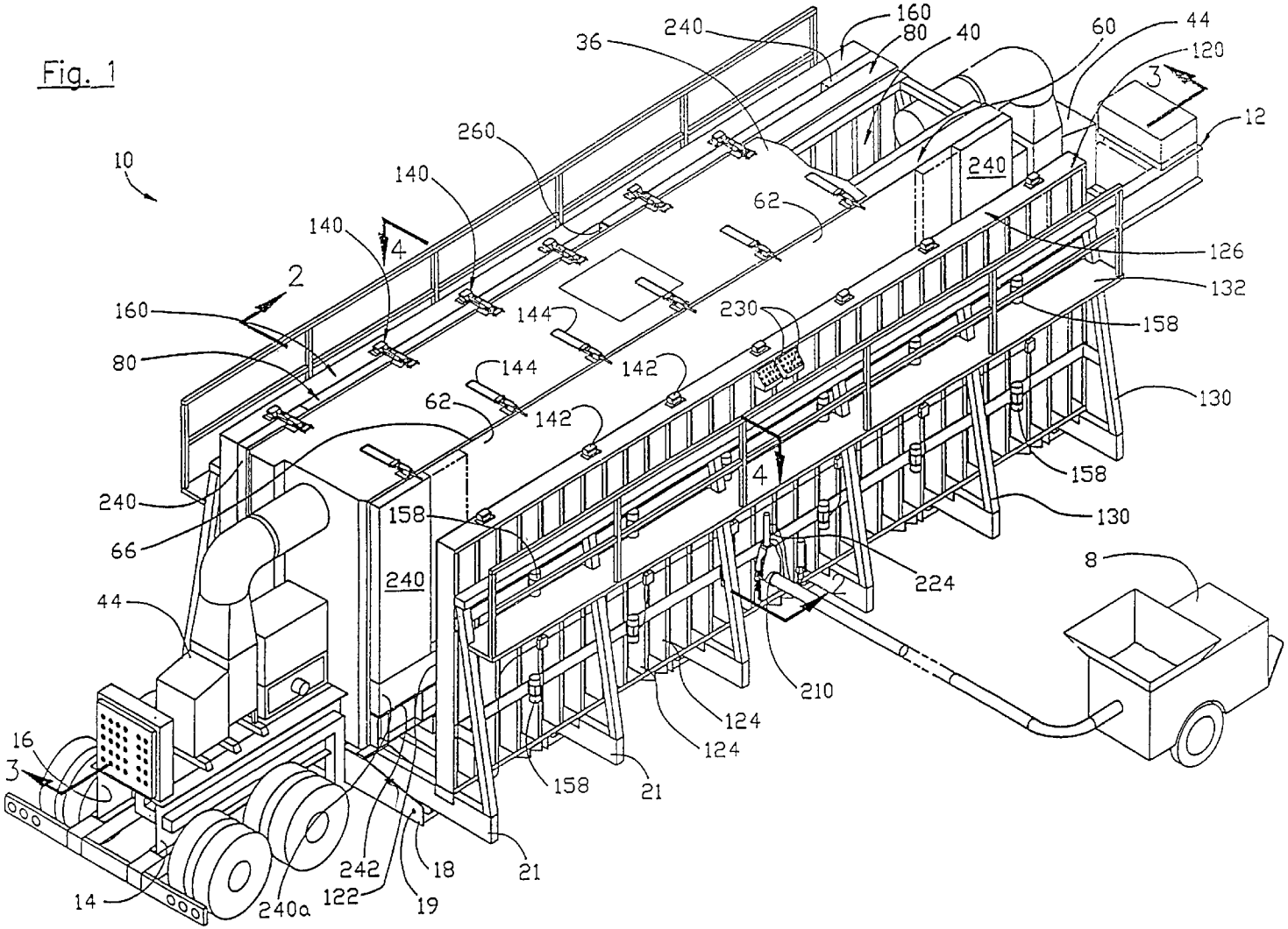
FIG. 1 is a perspective view of the present invention connected to a concrete supply.

Referring to FIG. 1, the variable wall molding apparatus 10 includes a trailer 12 having a furnace plenum 40, first and second fixed walls 60,80, and first and second movable walls 120,160.

Figure 2:
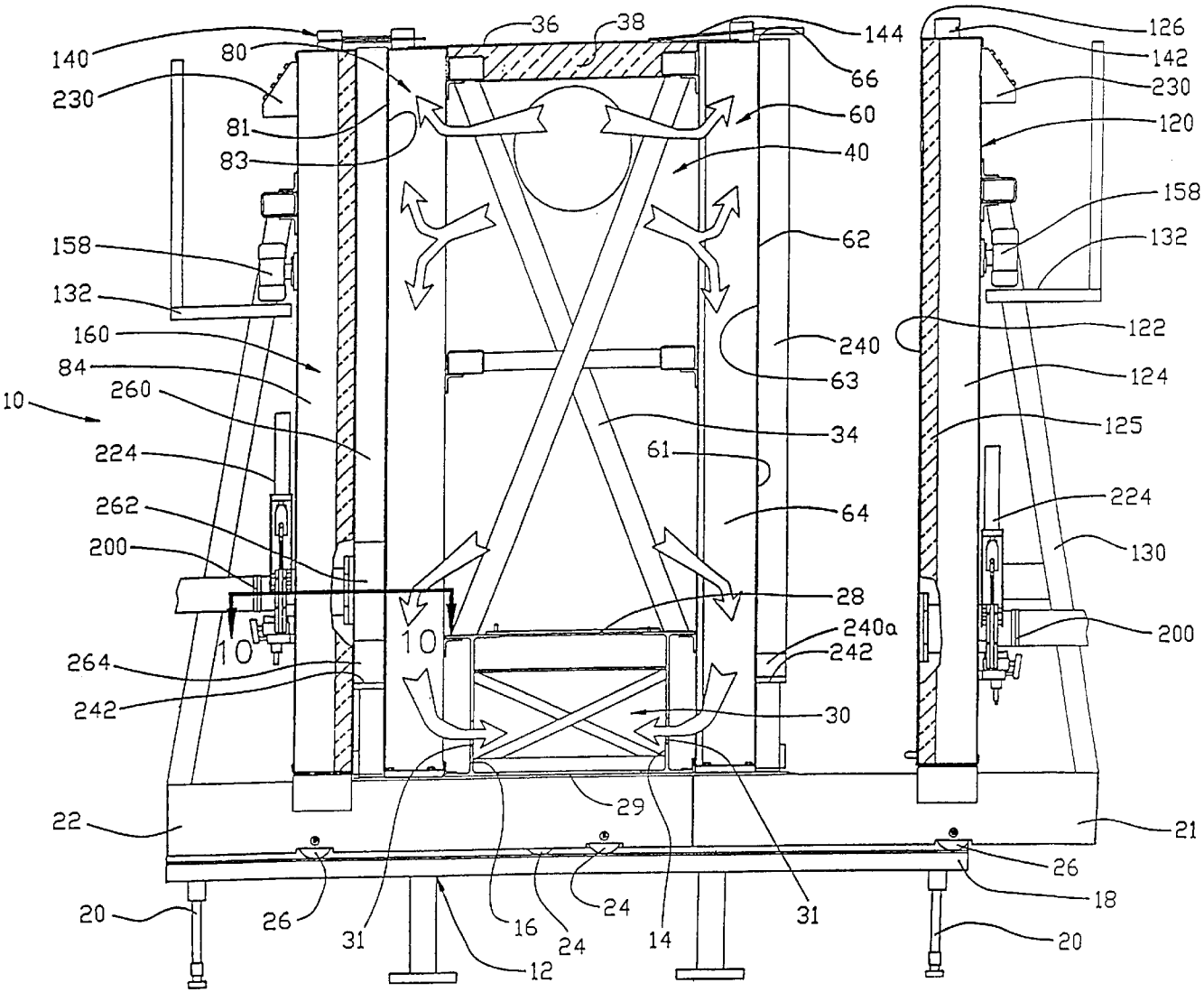
FIG. 2 is a cross sectional view taken along lines 2—2 of FIG. 1.
Figure 4:
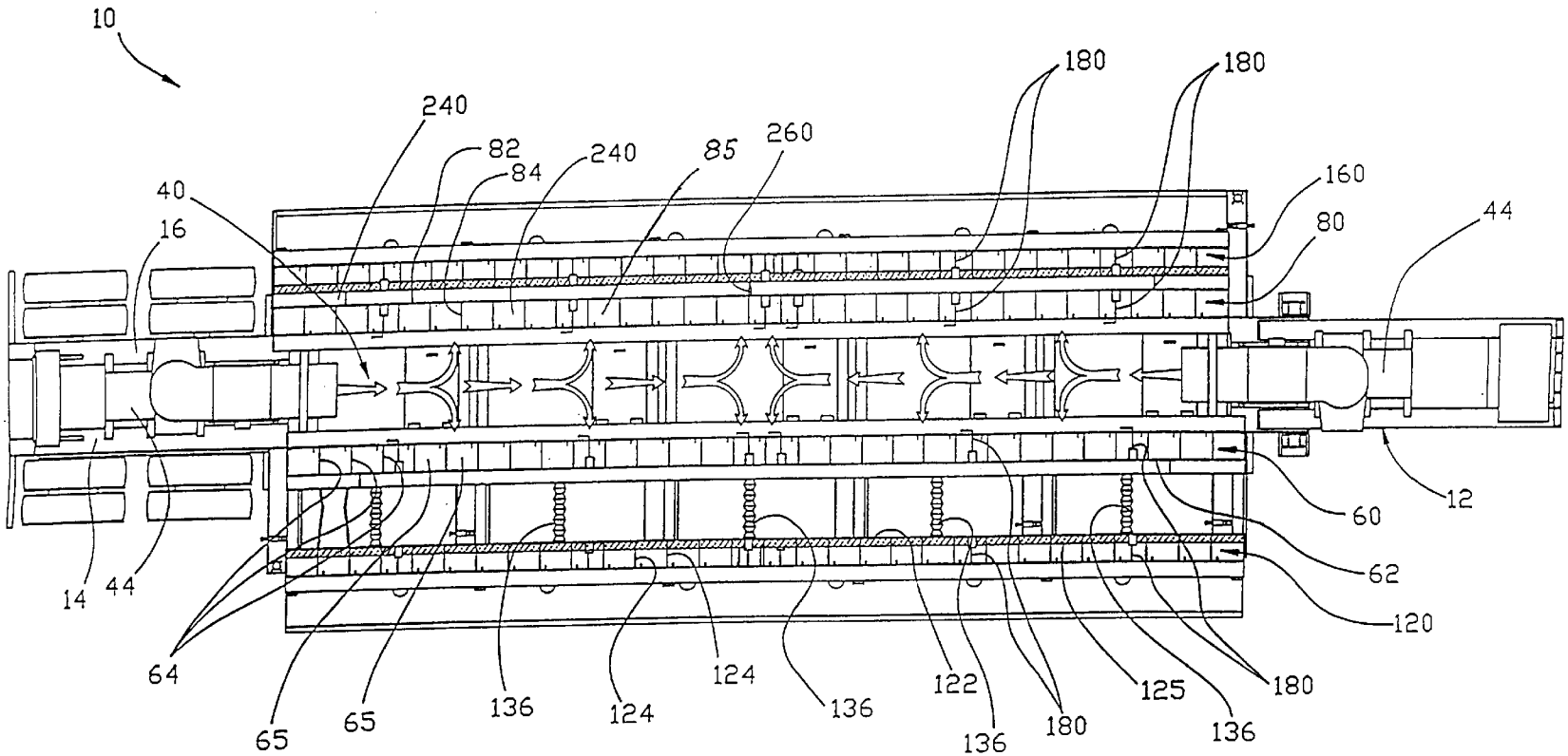
FIG. 4 is a cross sectional view taken along lines 4—4 of FIG. 1.

As shown in FIGS. 1, 2 and 4, the fixed wall 60 and the movable wall 120 are shown in an open position, while the fixed wall 80 and the movable wall 160 are shown in a casting position. Referring to FIGS. 1 and 2, a concrete supply 8 is shown connected to the movable wall 120. As the movable wall 120 is not in a casting position, there is no concrete in the line connecting the concrete supply 8 to the molding apparatus 10.

Trailer

The trailer 12 cooperatively engages a truck tractor (not shown) to permit ready transport of the molding apparatus 10.

As shown in FIG. 2, the trailer 12 includes a pair of parallel I-beams 14,16 extending the length of the trailer. A plurality of transverse channels 18 are affixed to the underside of the I-beams 14,16, and extend perpendicular to the length of the trailer 12. Each channel 18 includes a depending leveler 20 at each end of the channel. The depending leveler 20 selectively displaces the end of the channel 18 relative to the ground to ensure a level orientation of the apparatus 10.

A pair of transverse beams 21,22 is slidably received within each channel 18. Each beam 21,22 includes an inner and outer set of rollers 24,26 for slidably moving the beams 21,22 within the channel 18.

Figure 3:
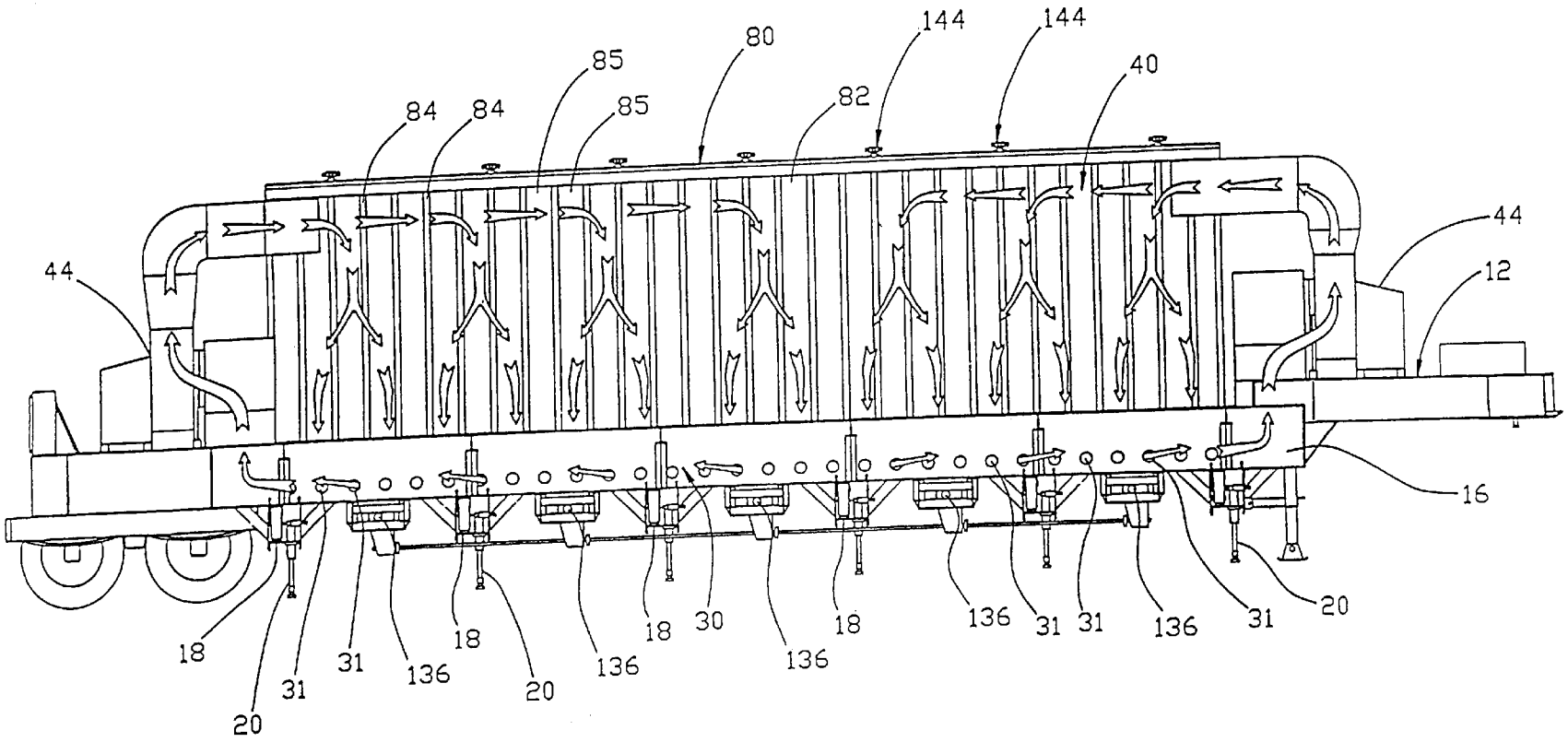
FIG. 3 is a cross sectional view taken along lines 3—3 of FIG. 1.

Referring to FIG. 2, the top of the I-beams 14,16 are interconnected by upper panel 28 and the bottom of the I-beams are interconnected by a lower panel 29 to enclose the space between I-beams 14,16 thereby defining a return manifold 30. Each I-beam 14,16 includes a plurality of return ports 31. As shown in FIG. 3, the return ports 31 extend along the length of the return manifold 30.

Fixed Walls

Referring to FIG. 2, the fixed walls 60,80 are attached to the outside of the return manifold 30 to define a substantial portion of the furnace plenum 40. The fixed walls 60,80 are vertically oriented and extend upward from opposite sides of the return manifold 30. Each fixed wall 60,80 includes mold side 61,81 and plenum side 63,83. The mold sides 61,81 form planar vertical surfaces for forming a concrete panel. Preferably, each of the fixed walls 60,80 defines a vertically oriented molding surface having an overall height of approximately 10 feet and a length of approximately 30 feet.

Referring to FIGS. 1, 2 and 4, the fixed walls 60,80 and the movable walls 120,160 are symmetrically oriented about the longitudinal axis of the molding apparatus 10. The fixed walls 60,80 are identical to each other in structure and operation. Similarly, the movable walls 120,160 are identical to each other in structure and operation. Therefore, for purposes of clarity of the disclosure, only the fixed wall 60 and the movable wall 120 will be described in detail. The remaining fixed wall 80 and the movable wall 160 may be taken as having similar structure and function as the corresponding fixed wall 60 and the movable wall 120.

As shown in FIGS. 2 and 4, the fixed wall 60 is formed by a skin plate 62 and a plurality of Z-members 64. The skin plate 62 is 0.25 inch steel, and defines the molding surface against which a portion of the concrete panel is cast. Referring to FIG. 4, the Z-members 64 are vertically oriented and evenly aligned to define channels 65 between the adjacent Z-members. As shown in FIG. 2, the Z-members 64 have a first end welded to a plenum side 63 of the skin plate 62. The lower portion of the second end of the Z-members 64 is affixed to the I-beam 14 such that the channels 65 between adjacent Z-members 64 are in fluid communication with the return ports 31, and hence the return manifold 30.

Figure 13:
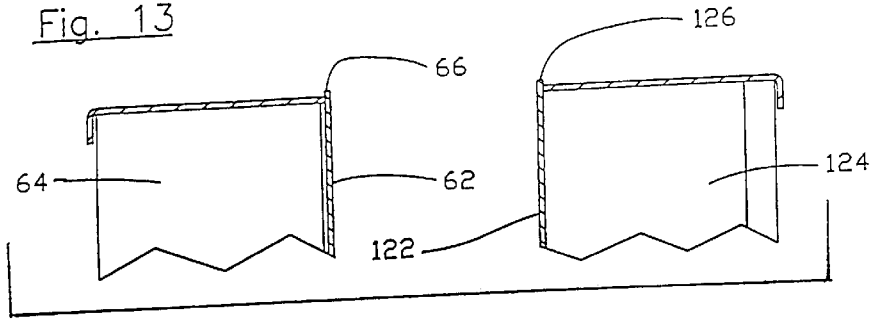
FIG. 13 is a partial cross sectional view taken along lines 13—13 of FIG. 5.

Referring to FIGS. 1, 2, and 13 the top of the skin plate 62 forms a screeding edge 66. The screeding edge 66 provides a level and accurate surface perpendicular to the plane of the skin plate 62.

Returning to FIG. 2, a core frame 34 is formed between the fixed walls 60,80 above the return manifold 30. The core frame 34 interconnects the Z-members of the fixed walls 60,80. The top of the core frame 34 and top of the Z-members of the fixed walls 60,80 cooperate with an upper deck 36 to enclose the top of the furnace plenum 40. The plenum side of the deck 36 includes insulation 38 such as polyurethane to retain thermal energy within the furnace plenum 40.

The furnace plenum 40 includes substantially the entire area of the skin plate of each fixed wall 60,80. Therefore, approximately one-half of the surface area of the mold is in direct thermal contact with the furnace plenum 40.

Furnace Units

As shown in FIGS. 1 and 3–5, a pair of furnace units 44 are disposed on the trailer 12 such that one furnace unit is fluidly connected to each end of the furnace plenum 40 and the return manifold 30. The remaining area of each end of the furnace plenum 40 is sealed to enclose the furnace plenum. Each furnace unit 44 includes a 60 kilowatt air duct heater such as TDH 60C as Manufactured by Chromalox of Pennsylvania, and a blower having a capacity of approximately 6000 cubic feet per minute. To enhance thermal efficiency, the furnace units 44 and connecting duct work outside of the furnace plenum 40 are encapsulated with insulation.

Referring to FIGS. 2, 3 and 4, a fluid path is defined from the furnace units 44 into the furnace plenum 40, through the channels 65,85 formed by the Z-members 64,84 and the respective skin plate 62,82 of each fixed wall 60,80, through the return ports 31, and the return manifold 30 to the furnace units 44.

Movable Walls

As previously stated, each movable wall 120,160 is identical in terms of relevant structure and function. Therefore, only movable wall 120 will be discussed in detail.

Referring to FIGS. 1, 2, 4 and 10, the movable wall 120 is similar to the fixed walls 60,80 and is formed of a skin plate 122 and Z-members 124. The skin plate 122 is formed of 0.25 inch steel. The first end of each Z-member 124 is welded to the outside of the skin plate 122 so as to retain the skin plate in a substantially planar, vertical orientation. The second end of each Z-member 124 is connected to an adjacent Z-member 124 by framing to provide structural rigidity. Similar to the fixed walls 60 and 80, the Z-members in the movable wall 120 form channels between adjacent Z-members. As shown in FIGS. 2 and 4, the channels in the movable wall 120 are at least partially filled with insulation 125, such as polyurethane.

Figure 11:
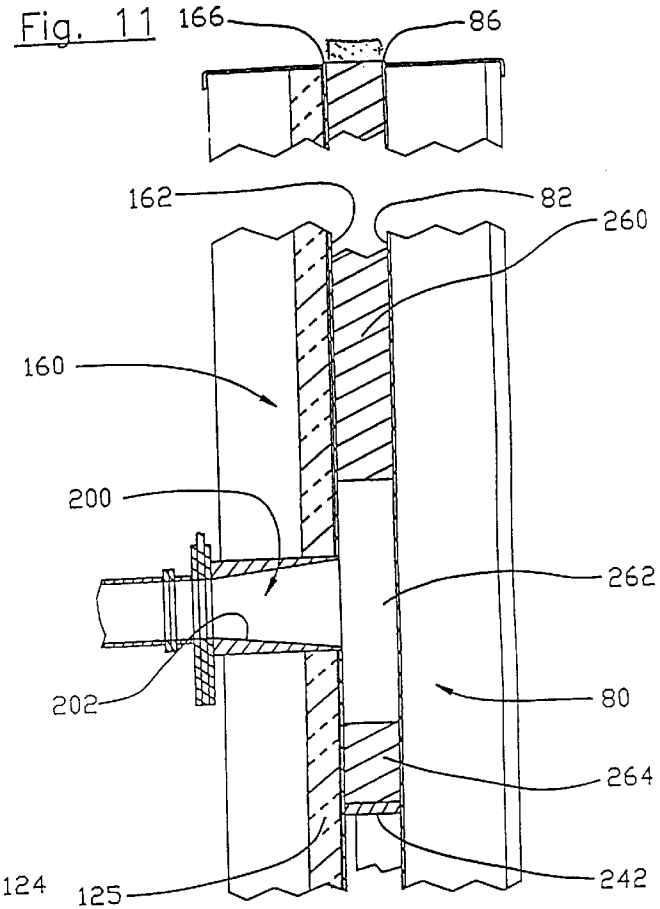
FIG. 11 is a partial cross sectional view taken along lines 11—11 of FIGS. 10.

Referring to FIGS. 2 and 13, the top of the skin plate 122 forms a screeding edge 126 for cooperating with the screeding edge 66 of the fixed wall 60 for leveling the top of the concrete in the mold. FIG. 11 discloses a detail of the top of fixed wall 80 and movable wall 160 showing corresponding screeding edges 86,166.

Figure 5:
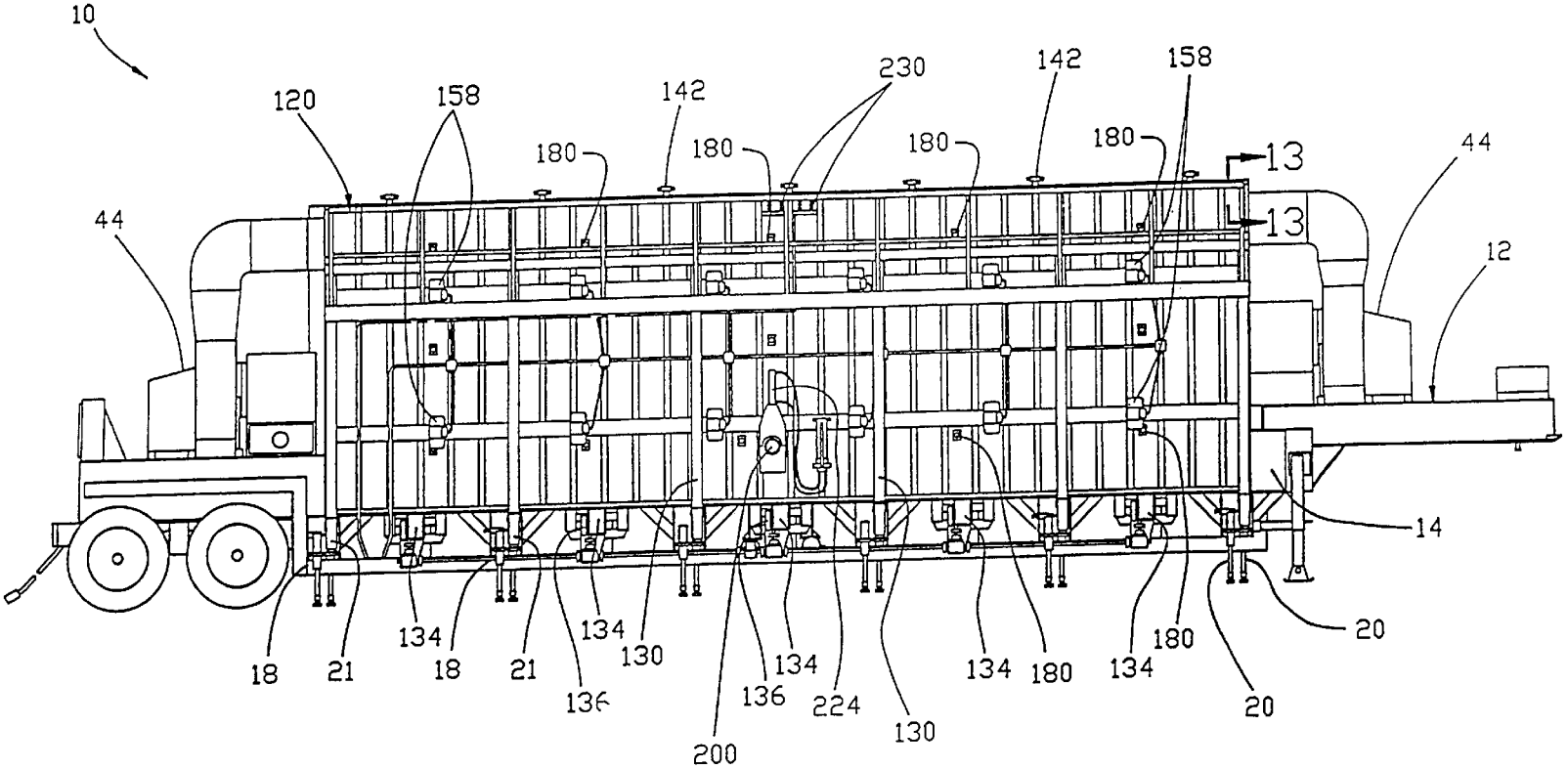
FIG. 5 is a side elevational view of the present invention.

As shown in FIGS. 1, 2 and 5, the bottom of the movable wall 120 is affixed to a plurality of the transverse beams 21, intermediate of the ends of the beams. Similarly, the bottom of the movable wall 160 is affixed to a plurality of transverse beams 22.

The movable wall 120 is mounted on the transverse beams 21 above the outer set of rollers 26. Struts 130 extend from the outer end of the transverse beams 21 to engage the upper portion of the movable wall 120. The movable wall 120 is thereby fixedly retained relative to the transverse beams 21. Each movable wall 120,160 includes a walkway 132 for accessing the respective screeding edges 66, 126 and 86, 166 and the top of the mold. The movable walls are mounted on the transverse beams to be movable between a first position adjacent the corresponding fixed wall for forming the mold, and a second position approximately 29 inches from the corresponding fixed wall.

Referring to FIG. 5, the bottom of each movable wall 120,160 includes a plurality of depending pads 134. The pads 134 are located intermediate of the transverse channels 18 and depend directly below the movable wall.

Referring to FIGS. 3–5, a plurality of machine screw actuators 136 are coupled between the depending pads 134 and the trailer 12. The machine screw actuators 136 are Model 9010 machine screw actuators manufactured by the Duff-Norton Company of Charlotte, North Carolina. The actuators 136 are commonly controlled, as well known in the art, to provide simultaneous activation and maintain the parallel orientation of the movable wall and the fixed wall as the movable wall is disposed between the first and the second position.

Referring to FIGS. 1, 2, 3 and 5, the top of each fixed wall 60,80 and corresponding movable wall 120,160 includes a plurality of cooperating upper locks 140 for selectively precluding motion of the walls when in the casting position. The upper locks 140 for each fixed and movable wall pair, includes a capture block 142 on one wall and an adjustable loop 144 on the remaining wall. The adjustable loop 144 permits the upper lock 140 to lock the walls at a variety of distances.

Figure 12:
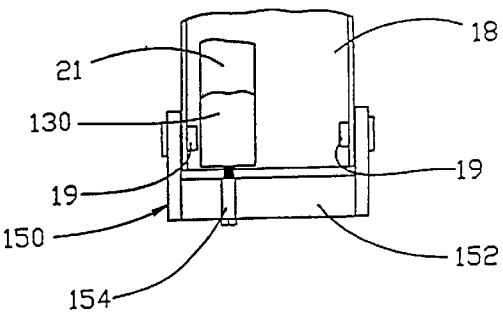
FIG. 12 is a top plan view showing a lower lock assembly.

As shown in FIG. 12, the apparatus 10 also includes lower locks 150 for securing the relative position of a pair of fixed and movable walls when in the casting position. Each lower lock 150 includes a U-shaped bracket 152 and adjusting bolt 154 threaded through the closed end of the bracket 152. The outer ends of each transverse channel 18 include a pair of opposing recesses or apertures 19 for cooperatively engaging the open ends of the bracket 152. To lock a transverse beam 21 or 22 with respect to the corresponding channel 18, the open ends of the bracket 152 are engaged with the apertures 19 in the channel 18. The adjusting bolt is threaded until it contacts the outer end of the transverse beam, thereby precluding motion of the movable wall away from the corresponding fixed wall.

As shown in FIGS. 1, 2 and 5, vibrators 158 are attached to the movable walls 120,160 along upper and lower rows. The vibrators are external impact vibrators such as AR 06/460 vibrators manufactured by the Wacker Corporation of Menomnee Fall, Wisconsin. The vibrators 158 consolidate and compact the concrete in the mold to reduce the number and size of the trapped air pockets at the interface of the mold and the concrete. In addition, the vibrators 158 enhance the flow of concrete within the mold during the casting process.

Figure 6:
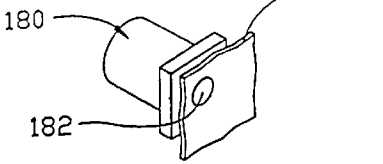
FIG. 6 is a localized perspective view showing a push-off valve in relation to a wall of the mold.
Figure 7:
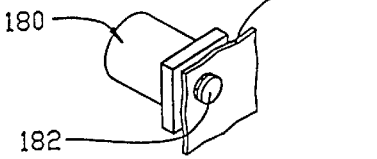
FIG. 7 is a localized perspective showing an actuated push-off valve spaced apart from the surrounding mold wall.

As shown in FIGS. 4 and 5, each of the fixed and movable walls include a plurality of push-off valves 180. Referring to FIGS. 6 and 7, the push-off valves 180 include air actuated poppets 182. In the default position, the poppets 182 are coplanar with the surrounding portion of the skin plate, or mold surface, such that the local area of the poppet and the skin plate define a planar surface. Actuation of the push-off valve 180 disposes the poppet 182 intermediate of the movable wall and fixed wall, that is, within the mold so as to push against a molded concrete structure such as a panel, thereby separating the molded concrete structure from the mold wall.

Concrete Inlets

Referring to FIGS. 1, 2, 5, 10 and 11, each movable wall 120,160 includes a concrete inlet 200 in the lower portion of the wall. As the concrete inlet 200 in each movable wall 120,160 is identical in structure and function, a single concrete inlet will be described in detail.

The concrete inlet 200 includes a tapered transition orifice 202 between the concrete supply line and the mold, such that the larger diameter of the orifice 202 terminates at the mold wall. The transition orifice 202 flares from a diameter of five inches to terminate in the plane of the skin plate at a diameter of seven inches.

Flow through the concrete inlet 200 is controlled by a valve mechanism 210. The valve mechanism 210 controls introduction of concrete into the mold defined between the fixed and movable walls.

Figure 9:
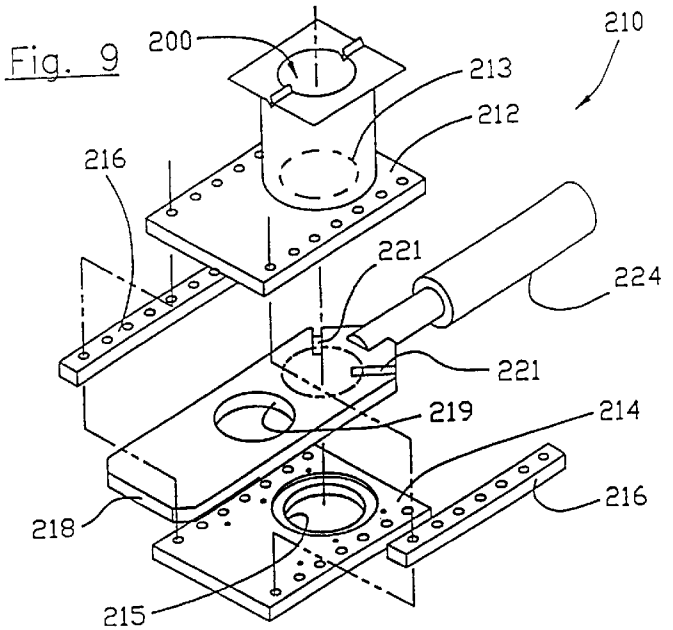
FIG. 9 is an exploded perspective of the valve mechanism showing closed, venting position.
Figure 8:
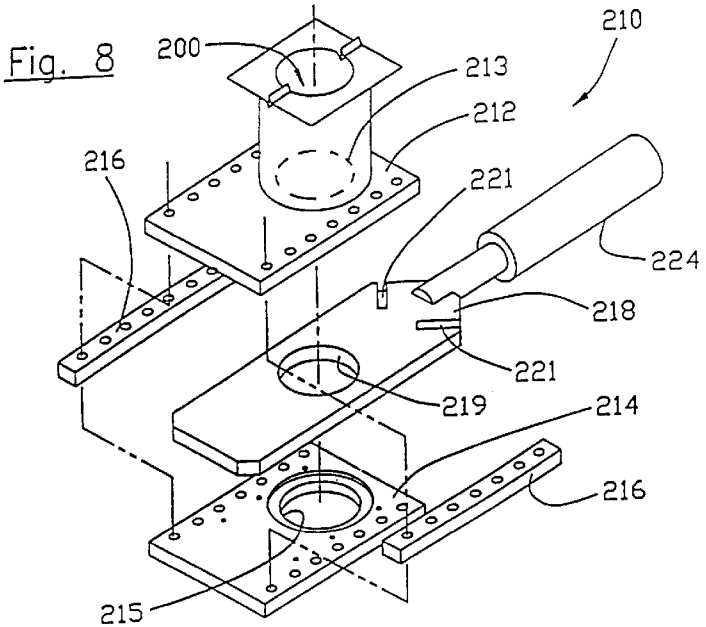
FIG. 8 is an exploded perspective of the valve mechanism in a first open position.

Referring to FIGS. 8 and 9, the valve mechanism 210 includes an inlet housing 212 and an outlet housing 214. The inlet housing 212 includes an inlet aperture 213, and the outlet housing 214 includes an outlet aperture 215, wherein the inlet and outlet apertures are of equal size. The inlet and outlet housings 212,214 are separated by lateral spacers 216.

A cutoff blade 218 is slidably disposed between the inlet and outlet housings 212,214 and intermediate of the lateral spacers 216. The cutoff blade 218 includes a central aperture 219 having a size equal to the inlet and outlet apertures 213,215. The cutoff blade 218 also includes vent channels 221 extending from the edge of the blade to terminate within a circumference equal to the circumference of the inlet aperture 213. The terminal ends of the vent channels 221 are spaced from the central aperture 219 by a distance greater than the diameter of the inlet aperture 213.

The cutoff blade 218 is movable relative to the inlet and outlet housings 212, 214, to assume three operative positions. In the first position, the central aperture 219 aligns with the inlet and outlet apertures 213,215 to permit a flow of concrete through the valve mechanism 210. In the second position, the cutoff blade 218 is oriented to preclude fluid communication between the inlet and outlet apertures 213, 215. In the third position fluid communication between the inlet and outlet apertures 213,215 is precluded, while the inlet aperture 213 is fluidly connected to atmospheric pressure through the vent channels 221. A hydraulic mechanism 224 is used to move the cutoff blade 218 relative to the housings.

Preferably, the concrete inlets 200 are located such that during filling of the mold, at least a portion of the concrete introduced through the concrete inlet into the mold acts against a pressure head of concrete already in the mold.

Although the concrete inlet 200 may be located at any vertical position in the mold, the concrete inlet is preferably located at the midpoint of the mold, or lower.

While the concrete inlets 200 are shown in the lower portions of the moveable walls 120,160, the concrete inlets may be located in the lower portion of the fixed walls 60,80, bulkheads in the ends of the mold, or the bottom of the mold. Alternatively, the concrete inlets 200 may be entirely eliminated, wherein the concrete is poured into the top of the mold, and the introduced concrete does not act against a pressure head of concrete in the mold.

In the preferred embodiment, the horizontal actuators 136, and the vibrators 158 are selectively actuated through control panels 230 associated with each movable wall. The control panels 230 reduce the number of workers, and safely locate the operator during formation of the concrete panels.

Figure 10:
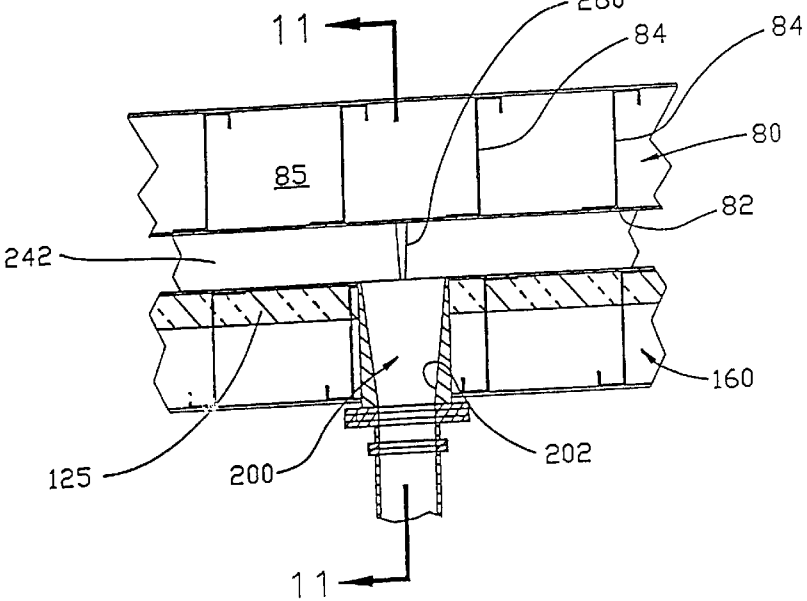
FIG. 10 is a partial cross sectional view taken along lines 10—10 of FIG. 2.

Referring to FIGS. 1, 10 and 11, the molding apparatus 10 may include a divider 260 vertically oriented in the mold. The divider 260 substantially separates the mold into two distinct compartments. The divider 260 is oriented to bisect the length of the mold and bisect the concrete inlet 200. Referring to FIG. 11, the divider 260 is positioned to define an inlet slot 262. The inlet slot 262 extends beyond the diameter of the transition orifice 202. Preferably, the divider 260 cooperates with a lower portion 264 extending across the width of the mold, below the inlet slot 262. Referring to FIG. 10, the divider 260 has a tapered cross section. That is, the divider 260 is narrowest adjacent the movable wall and widest adjacent the fixed wall, wherein the divider flares from a width of approximately 13/16" to a width of approximately 1".

Operation

The present invention provides for the mass production of reinforced vertical concrete panels. The concrete panels may have any length and height which is less than the length and height of the fixed and movable walls. The thickness of the concrete panel is determined by the maximum separation of the movable wall from the fixed wall, such that the maximum separation of the mold walls includes the thickness of the concrete panel and a release space for separating the concrete structure from the mold. The panels may also be formed to include window or door apertures and conduits for electrical and environmental services.

As shown in FIGS. 1, 2 and 4, bulk heads 240, 240*a* and bottom gauge 242 are disposed relative to the fixed walls 60,80 to define the desired thickness, length and height of the concrete structure to be formed. The bulk heads 240, 240*a* and bottom gauge 242 space the movable wall from the fixed wall and determine the height, width and length of the structure to be formed when the walls are in the molding position. In addition, the bulk heads 240*b* (not shown) may be disposed at any location within the mold to define windows, doors or other desired openings in the final product. The surfaces of the mold are treated to enhance subsequent separation of the cured concrete and the mold, as well known in the art. A reinforcing bar frame (not shown) is disposed between the inner and outer walls.

The horizontal actuators 136 are activated to draw the movable wall towards the fixed wall such that the fixed wall, the movable wall, the bulk heads 240, 240*a* and the bottom gauge 242 form the mold. The upper and lower locks 140,150 are engaged to secure the walls in the molding position.

The furnace units 44 are activated to force hot air in the furnace plenum 40. Referring to FIGS. 2–4, the heated air travels into the furnace plenum and descends between adjacent Z-members, transferring heat to the skin plates of the fixed walls 60,80. The heated air passes through the return ports 31 and into the return manifold 30. The heated air exits the return manifold 30 to be reintroduced into the furnaces 44, reheated and recirculated. The fixed walls 60,80 are heated to a temperature in excess of 100° F. prior to introduction of concrete into the mold. Preferably, the mold cavity is covered with an insulating blanket or board (not shown) to retain the thermal energy in the mold. The insulation on the moveable walls 120, 160 and deck 36 also serves to retain the thermal energy in the mold.

Prior to introduction into the mold, the concrete is preheated to a temperature in excess of 85° F. Upon sufficient heating of the mold cavity and the concrete, the concrete supply line is connected to the valve mechanism 210. The concrete is pumped to a pressure of approximately 400 to 500 psi. The hydraulic mechanism 224 is used to align the central aperture 219 of the cutoff blade 218 with the inlet and outlet apertures 213,215. Concrete then passes into the transition orifice 202 at a flow rate of approximately 75 cubic yards per hour.

As the concrete flows to the larger cross sectional area of the transition orifice 202, the velocity of the flow is reduced. The passage of the concrete to the larger cross sectional area of the concrete inlet 200 reduces frictional losses, thereby promoting flow of concrete into the mold. The concrete enters the mold at a reduced velocity and flows towards the ends of the mold.

The vibrators 158 are activated to enhance flow of concrete within the mold. If the divider 260 is employed, the concrete flows to both sides of the divider. After the desired quantity of concrete is injected into the mold, the valve mechanism 210 is closed by placing the cut-off blade 218 in the second position to preclude further introduction of concrete into the mold and to hold back the fluid pressure head of the concrete in the mold.

Upon closure of the valve mechanism 210, the supply line is full of concrete. To safely disconnect the supply line, the concrete must be drawn back through the supply line. The valve mechanism 210 is moved to the third position, the overdrawn position, to expose the vent channels 221 to the inlet aperture 213 and the supply line. As the concrete is drawn back through the supply line, air passes through the vent channels 221 into the supply line to prevent creation of a vacuum within the line.

The top of the concrete in the mold is screeded along the screeding edges of the fixed and movable walls.

The continued heating of the fixed walls 60,80 by the furnace plenum 40 accelerates curing of the concrete, and reduces the time to realize the heat of hydration. The insulation on the movable walls 120, 160 and deck 36, and insulating blanket on top of the mold cavity increase the thermal retention of the mold cavity.

Upon sufficient curing of the concrete, the actuators 136 and the push-off valves 180 are actuated. The poppets 182 are urged against the concrete, and simultaneously the movable wall is slightly disposed away from the fixed wall by the horizontal actuators 136. The concrete panels are thereby separated from the walls. The cooperation of the push off values 180 and horizontal actuators 136 provide for uniform separation of the concrete panel from the mold. The concrete panels are lifted by a crane and set on to holding stands, or immediately set into place and allowed to cure.

If the divider 260 is employed the only contiguous concrete link between the separate compartments in the mold is the area of the inlet slot 262. As this concrete does not include reinforcing bar, and is still green, the concrete is scored and is easily fractured, thereby producing two separate panels from a single mold.

While one pair of a fixed and movable wall is molding a concrete panel, the remaining pair of walls may be cleared and prepared for molding, thereby reducing down time of the apparatus.

Although a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A portable concrete molding apparatus, comprising:

(a) a portable trailer having a longitudinal axis;

(b) a first fixed wall affixed to the trailer, the first fixed wall including an outer substantially planar mold surface and a second plenum surface, the first fixed wall including a plurality of rib members extending from the plenum surface to form a plurality of heating channels adjacent the first fixed wall;

(c) a second fixed wall affixed to the trailer parallel to the first fixed wall and spaced apart from the first fixed wall by a given distance, the second fixed wall including an outer substantially planar mold surface and a second plenum surface, the second fixed wall including a plurality of rib members extending from the plenum surface of the second fixed wall to form a plurality of heating channels adjacent the plenum surface of the second fixed wall, wherein the plenum surface of the second fixed wall opposes the plenum surface of the first fixed wall;

(d) a housing extending between the first fixed wall and the second fixed wall to form a furnace plenum therebetween, the furnace plenum including a return duct fluidly connected to the heating channels of the first fixed wall and the second fixed wall, the furnace plenum having an inlet exposed to the heating channels of the first fixed wall and the second fixed wall and an outlet exposed to the return duct;

(e) a heater having an inlet and an outlet, wherein the heater outlet is fluidly connected to the furnace plenum inlet and the heater inlet is fluidly connected to the furnace plenum outlet to form a substantially closed fluid circuit between the heater and the furnace plenum;

(f) a plurality of transverse channels connected to the trailer transverse to the longitudinal axis;

(g) a first set of transverse beams slideably disposed within the transverse channels;

(h) a second set of transverse beams slideably disposed within the transverse channels;

(i) a first movable wall connected to the first set of transverse beams for movement relative to the first fixed wall between a casting position adjacent the mold surface of the first fixed wall for forming a first mold therebetween and a discharging position remote from the first fixed wall, the first mold including a first concrete inlet for introducing concrete into the first mold; and (j) a second movable wall connected to the second set of transverse beams for movement relative to the second fixed wall between a casting position adjacent the mold surface of the second fixed wall for forming a second mold therebetween and a discharging position remote from the second fixed wall, the second mold including a second concrete inlet for introducing concrete into the second mold.

2. The portable concrete molding apparatus of claim 1, further comprising:

(a) a plurality of push-off valves connected to one of the first and the second molds, the push-off valves movable between a first casting position substantially coplanar with an adjacent to a surface of the associated mold wall and a second position extending into said one mold.

3. The concrete molding apparatus of claim 1, further comprising;

(a) a divider substantially separating one of the first and the second molds into compartments, wherein each compartment is fluidly connected to the associated concrete inlet.

4. The concrete molding apparatus of claim 1, further comprising;

(a) insulation on a portion of one of the first and the second molds for reducing thermal transfer from the one mold.

5. The concrete molding apparatus of claim 1, further comprising;

(a) a plurality of vibrators connected to one of the first and the second molds for consolidating concrete in the one mold.

6. The concrete molding apparatus of claim 1, further comprising;

(a) a lock mechanism for releasably locking one of the first fixed wall and the second fixed wall relative to one of the first movable wall and the second movable wall respectively.

7. A portable concrete molding apparatus, comprising:

(a) a portable trailer;

(b) a first fixed wall affixed to the trailer, the first fixed wall including an outer substantially planar mold surface and a second plenum surface, the first fixed wall including a plurality of rib members extending from the plenum surface to form a plurality of heating channels adjacent the first fixed wall;

(c) a second fixed wall affixed to the trailer parallel to the first fixed wall and spaced apart from the first fixed wall by a fixed distance, the second fixed wall including an outer substantially planar mold surface and a second plenum surface, the second fixed wall including a plurality of rib members extending from the plenum surface to form a plurality of heating channels adjacent the second fixed wall and wherein the plenum surface of the second fixed wall opposes the plenum surface of the first fixed wall;

(d) a housing extending between the first fixed wall and the second fixed wall to form a furnace plenum therebetween, the furnace plenum including a return duct fluidly connected to the heating channels of the first fixed wall and the second fixed wall, the furnace plenum having an inlet exposed to the heating channels of the first fixed wall and the second fixed wall and a remote outlet exposed to the return duct;

(e) a heater having an inlet and an outlet, wherein the heater outlet is fluidly connected to the furnace plenum inlet and the heater inlet is fluidly connected to the furnace plenum outlet to form a substantially closed fluid circuit;

(f) a first movable wall connected to the trailer and movable relative to the first fixed wall between a casting position adjacent the mold surface of the first fixed wall for forming a first mold therebetween and a discharging position remote from the first fixed wall, the first mold including a first transition orifice located below mid-height of the first mold for introducing concrete into the first mold;

(g) a first cutoff valve fluidly connected to the first transition orifice for selectively permitting passage of concrete through the first transition orifice;

(h) a second movable wall connected to the trailer and movable relative to the second fixed wall between a casting position adjacent the mold surface of the second fixed wall for forming a second mold therebetween and a discharging position remote from the second fixed wall, the second mold including a second transition orifice located below mid-height of the second mold for introducing concrete into the second mold; and (i) a second cutoff valve fluidly connected to the second transition orifice for selectively permitting passage of concrete through the second transition orifice.

8. The concrete molding apparatus of claim 7, wherein the first cutoff valve further comprises;

(a) a valve housing having an inlet aperture and a remote outlet aperture, wherein the outlet aperture is intermediate of the inlet aperture and the first transition orifice; and (b) a cutoff blade movably connected to the valve housing and having a central aperture for movement between a first position fluidly connecting the inlet aperture and the outlet aperture through the central aperture and a second position precluding fluid communication from the inlet aperture to the outlet aperture.

9. The concrete molding apparatus of claim 8, wherein the cutoff blade includes a vent for fluidly connecting the inlet aperture to an ambient pressure upon the cutoff blade being disposed in the second position.

10. The concrete molding apparatus of claim 7, further comprising;

(a) a plurality of push-off valves connected to one of the first and the second molds, the push-off valves movable between a first casting position substantially coplanar with and adjacent to a mold surface and a second position extending into said one mold.

11. The concrete molding apparatus of claim 7, further comprising;

(a) a divider substantially separating one of the first and the second molds into compartments, wherein each compartment is fluidly connected to one of the first and the second transition orifices.

12. The concrete molding apparatus of claim 7, further comprising;

(a) insulation on a portion of one of the first and the second molds for reducing thermal transfer from said one mold.

13. The concrete molding apparatus of claim 7, further comprising;

(a) a plurality of vibrators connected to one of the first and the second molds for consolidating concrete in said one mold.

14. The concrete molding apparatus of claim 7, further comprising;

(a) a lock mechanism connected to one of the first fixed wall and the second fixed wall for releasably locking said one fixed wall relative to one of the first movable wall and the second movable wall respectively.

15. A portable concrete molding apparatus, comprising:

(a) a portable trailer having a longitudinal axis;

(b) a first fixed wall affixed to the trailer, the first fixed wall including an outer substantially planar mold surface and a second plenum surface;

(c) a second fixed wall affixed to the trailer parallel to the first fixed wall and spaced apart from the first fixed wall by a given distance, the second fixed wall including an outer substantially planar mold surface and a second plenum surface, wherein the plenum surface of the second fixed wall opposes the plenum surface of the first fixed wall;

(d) a housing extending between the first fixed wall and the second fixed wall to form a furnace plenum therebetween, the furnace plenum including a return duct the furnace plenum having an inlet exposed to the first plenum surface and the second plenum surface, and an outlet exposed to the return duct;

(e) a heater having an inlet and an outlet, wherein the heater outlet is fluidly connected to the furnace plenum inlet and the heater inlet is fluidly connected to the furnace plenum outlet to form a substantially closed fluid circuit between the heater and the furnace plenum;

(f) a plurality of transverse channels connected to the trailer transverse to the longitudinal axis;

(g) a first set of transverse beams slideably disposed within the transverse channels;

(h) a second set of transverse beams slideably disposed within the transverse channels;

(i) a first movable wall connected to the first set of transverse beams for movement relative to the first fixed wall between a casting position adjacent the mold surface of the first fixed wall for forming a first mold therebetween and a discharging position remote from the first fixed wall, the first mold including a first concrete inlet for introducing concrete into the first mold; and (j) a second movable wall connected to the second set of transverse beams for movement relative to the second fixed wall between a casting position adjacent the mold surface of the second fixed wall for forming a second mold therebetween and a discharging position remote from the second fixed wall, the second mold including a second concrete inlet for introducing concrete into the second mold.

16. The portable concrete molding apparatus of claim 1 in which the first concrete inlet and the second concrete inlet are located lower than mid-height of the first and second movable walls respectively.

17. The portable concrete molding apparatus of claim 15 in which the first concrete inlet and the second concrete inlet are located lower than mid-height of the first and second movable walls respectively.

* * * * *